United States Patent [19]

Studer et al.

[11] Patent Number: 4,508,130

[45] Date of Patent: Apr. 2, 1985

[54] METHOD AND APPARATUS FOR REPAIRING WATER LEAKS

[76] Inventors: Robert L. Studer; William E. Schourup, both of 16116 NE. 87th, Redmond, Wash. 98052

[21] Appl. No.: 528,721

[22] Filed: Aug. 31, 1983

[51] Int. Cl.[3] ..... F16K 43/00

[52] U.S. Cl. ..... 137/15; 137/318; 138/97; 138/99; 251/267

[58] Field of Search ..... 137/15, 315, 318; 138/89, 94, 94.3, 97, 98, 99, 90; 251/266, 267, 327; 285/31, 32, 341, 342, 343, 382.7

[56] References Cited

U.S. PATENT DOCUMENTS

| | | | |
|---|---|---|---|
| 104,568 | 6/1870 | Flower | 251/266 |
| 849,009 | 3/1907 | Castle | 251/266 |
| 1,462,834 | 7/1923 | Stenwall | 251/266 |
| 2,930,635 | 3/1960 | Woodling | 285/382.7 |
| 2,984,129 | 5/1961 | Allen | 137/318 |
| 3,687,166 | 8/1972 | Herrin | 137/318 |
| 3,972,547 | 8/1976 | Itoya | 285/382.7 |

*Primary Examiner*—George L. Walton

*Attorney, Agent, or Firm*—Hughes, Barnard & Cassidy

[57] ABSTRACT

A method of repairing a leak, where there is a water network with a main shutoff valve. An isolation valve is inserted in the pipe a short distance upstream of the leak, and the leak is repaired by using the local isolation valve to keep water from the repair location. This enables the main shutoff valve to be opened and distribute water to the other areas of the network. The isolation valve is particularly arranged to become a permanent part of the water system after the leak is repaired.

15 Claims, 5 Drawing Figures

METHOD AND APPARATUS FOR REPAIRING WATER LEAKS

BACKGROUND OF THE INVENTION

The present invention relates to an apparatus and method for repairing a leak in the water lines of a conventional plumbing system, such as those existing in many present day homes and commercial buildings.

BACKGROUND ART

For many years, the conventional method of providing a water distribution system for a building is provide a network of pipes (made of copper or some other suitable material) which extend from a main inlet to various locations in the home or other building structure, with a valve being provided at each discharge location. There is generally a main shut off valve at an upstream location, this valve being positioned so that it can shut off water to the entire network in the building. Also, at each discharge location, there is quite often provided an additional local shutoff valve so that any single discharge valve can be isolated from the rest of the water distribution network. For example, at the location of a valve for a wash basin, there is quite often a flexible fitting which leads from the end of the pipe to the valve. In the event that flexible fitting or the couplings for the same develops a leak, the local shutoff valve can be moved to the closed position to enable repairs to be made, such as replacing the discharge valve or otherwise repairing the leak.

However, when leaks develop upstream of the local shutoff valves, it is generally necessary to close the main shutoff valve for the entire water distribution network. In some instances, this can cause considerable inconvenience, not only for the person making the repair, but also for people in the building structure who may need water during the period when a repair is being made. Another complicating factor is that the repair of the leak may be accomplished properly in the first attempt, and this would be particularly true where the leak is repaired by sodering in a section of pipe or other member.

A typical situation would be as follows. Let it be assumed that there is a leak in one of the water distribution pipes in the crawl space beneath a building. The plumber first closes the main shutoff valve so as to isolate the water distribution network from any additional inflow of water. When the leak is located, then the plumber will quite often remove the damaged piece of pipe and replace it with a new pipe section, generally forming the joint by means of sodering. In order to soder the pipe, it is necessary not only to remove the water from the pipe, but also make sure that the residual moisture which may be in the immediate area of the sodered joint is removed. If this is not done, the pipe may not be brought to the proper temperature to enable the soder to seal properly. After the repair is made, the plumber then returns to the location of the main shutoff valve and opens the shutoff valve to again permit water to flow through the system. He must then return to the location of the leak to see if it has been repaired properly. If there is still a leak at the location of the repair, or possibly another leak nearby which may have been overlooked in the first repair operation, the plumber must then repeat the same process in closing the main shutoff valve, draining the line of water, etc.

To the best knowledge of the applicant, this general type of water distribution system for buildings and the method of making repairs for the same have remained the same for many years. The applicant himself has on any number of occasions experienced the inconvenience of attempting to repair leaks in somewhat the same manner as described above.

A search of the patent literature has revealed a number of devices and methods for joining one section of pipe to another, or a section of pipe to another member, so as to make a convenient and effective connection. While these relate generally to the field of making plumbing connections, these patents do not deal directly with the problem noted above with regard to repairing leaks in buildings. However, these patents are disclosed herein to insure that the applicant is making a full disclosure of whatever prior art is known.

U.S. Pat. No. 4,022,497, Kotsakis, illustrates a nut and sleeve coupling element where there is a ferrule joined to a nut having exterior threads. A female coupling member can be threaded onto the nut member so as to compress the ferrule to make a firm connection to a pipe positioned within the nut member, the female member and the ferrule.

Another such arrangement is shown in U.S. Pat. No. 2,536,552, Katz, where there are two sleeves which are arranged to make two spaced compression members that bear against the tube to make a firm connection.

U.S. Pat. No. 2,460,621, Courtot, shows a similar coupling device with another type of interior compression sleeve.

The other patents noted in the search are generally representative of the type of coupling noted above, so these will simply be listed, without any detailed description being added. These are:

U.S. Pat. No. 2,455,667, Franck;
U.S. Pat. No. 2,405,489, Brock;
U.S. Pat. No. 2,344,698, Howe;
U.S. Pat. No. 2,139,413, Kreidel;
U.S. Pat. No. 2,069,177, Craver;
U.S. Pat. No. 1,927,451, Dobrick;
U.S. Pat. No. 1,896,371, Quarnstrom;
U.S. Pat. No. 1,516,396, Mueller et al;
U.S. Pat. No. 1,307,540, Dohner;
U.S. Pat. No. 1,186,812, McFerran;
U.S. Pat. No. 871,607, Montgomery;
U.S. Pat. No. 190,965, Foster, Jr.

In view of the foregoing, it is an object of the present invention to provide a method for making repairs to leaks in a water distribution network such as that noted above, and also to an apparatus particularly adapted to be used in such method.

SUMMARY OF THE INVENTION

The method of the present invention is for repairing a leak in a water distribution network of a plumbing system where there is:

a. a distribution pipe having an upstream end and a downstream outlet end;

b. existing shutoff valve located upstream of the upstream end of the distribution pipe.

The method comprises first determining a leak location, and then closing the existing shutoff valve to stop the flow of water to the leak. Then an intermediate isolating location is selected in the distribution pipe downstream of the existing shutoff valve and upstream of the leak.

The distribution pipe is then cut at the isolating location to form two pipe portions. An isolation valve is inserted at the selected location to connect the two pipe portions. The isolating valve is then closed, and the existing shutoff valve is then opened. The leak is repaired, and then the isolating valve is opened to permit flow of water to the location of the leak.

If subsequent to the opening of the isolating valve a leak still exists, then the isolating valve can be closed to make a further repair on the pipe. In many water network installations, there will be other outlets at an upstream location. By opening the existing shutoff valve during the period when the leak is being repaired, these other locations can be served by the water network.

The specific valve of the present invention generally comprises a body portion defining a middle through recess, and a closure member movable between opened and closed positions. There are first and second annular connecting portions positioned on opposite sides of the recess. Each connecting portion has an interior cylindrical recess to receive a related end of the pipe, and a compression surface to bear against a ferrule positioned around the pipe. Each connecting portion has an exterior threaded surface adapted to receive a compression nut. The recess in the open position defines a substantially unobstructed thru opening so that water can flow through the pipe and the valve without any undue pressure loss. Desirably, each connecting portion has an annular shoulder to engage an edge portion of the pipe and thus locate the valve relative to the pipe.

With the isolation valve installed, the valve connects the two pipe portions, and there are two ferrules and two compression nuts on opposite sides of the valve, positioned around the pipe. The compression nuts are threaded onto the respective connecting portions of the valve to press the ferrule into sealing relationship.

Other features of the invention will become apparent from the following detailed description.

DESCRIPTION OF THE PREFERRED EMBODIMENT

Figure 1:
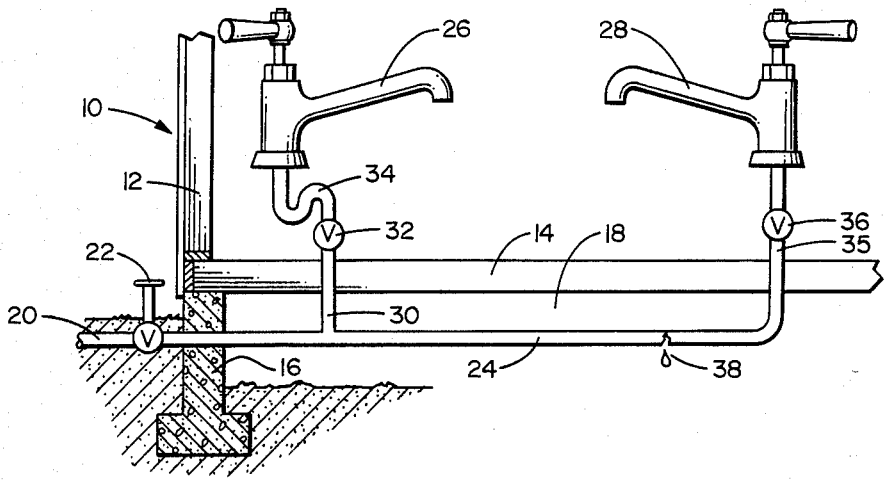
FIG. 1 is a side elevational view, partly in section, illustrating somewhat schematically a portion of a conventional water distribution network such as those commonly existing in homes or other building structures.

In FIG. 1, there is a simplified showing of a typical water distribution system for a home or other building structure, for which the present invention is particularly adapted. As shown herein, the building structure 10 has a wall 12, floor 14, footings 16, and a crawl space 18 being located immediately below the floor 14. The water distribution system has a main inlet pipe 20, which is generally placed underground to prevent freezing. At some upstream location there is a main shut off valve, indicated somewhat schematically at 22 at a location immediately outside of the building 10.

From the shutoff valve 22, there ar one or more distribution pipes which extend generally through closed or relatively inaccessible portions of the building 10. In FIG. 1, one such distribution pipe 24 is shown as being located in the crawl space 18, and this in turn feeds two distribution valves 26 and 28, respectively. The valve 26 is fed from an upstream location from a branch pipe 30 which leads to a local shutoff valve 32. From the local shutoff valve 32, in the particular arrangement shown herein, there is a flexible piece of tubing 34 which connects to the valve 26. The outlet valve 28 is also shown with a local shutoff valve 36 at the end of the pipe 35.

In FIG. 1, there is shown a leak 38 in the distribution pipe 24 at a location between the branch pipes 30 and 35. As described previously herein, the common prior art method of repairing such a leak would be to first locate the leak 38, and then close the main shutoff valve 22. Then, if the leak 38 is to be repaired by a sodering operation, it is necessary to insure that the pipe 24, at least in the vacinity of the leak 38, is substantially free of residual moisture within the pipe. Otherwise, the sodered joint may not be properly formed.

With the main shutoff valve 22 closed, water cannot be obtained from either of the valves 26 or 28, nor from any other outlet valve in the system. After the repair is made at the location of the leak 38, the main shutoff valve 22 is opened to again permit water to flow into the system. Ordinarily, the plumber repairing the leak 38 will then return to the leak location to make sure that a proper repair has been made. If it has not been made properly, then the plumber will again close the valve 22 and make a second attempt to repair the leak, From the above description, it is readily apparent that there is a certain inconvenience in making the repair, and also in isolating all of the outlet valves in the water system.

The present invention is particularly adapted to repair a leak in an environment such as described relative to FIG. 1. It is believed that a clearer understanding of the present invention will be obtained by first describing the details of the isolation valve which is particularly adapted for use in the present invention, and then describing the overall method of the present invention.

Figure 5:
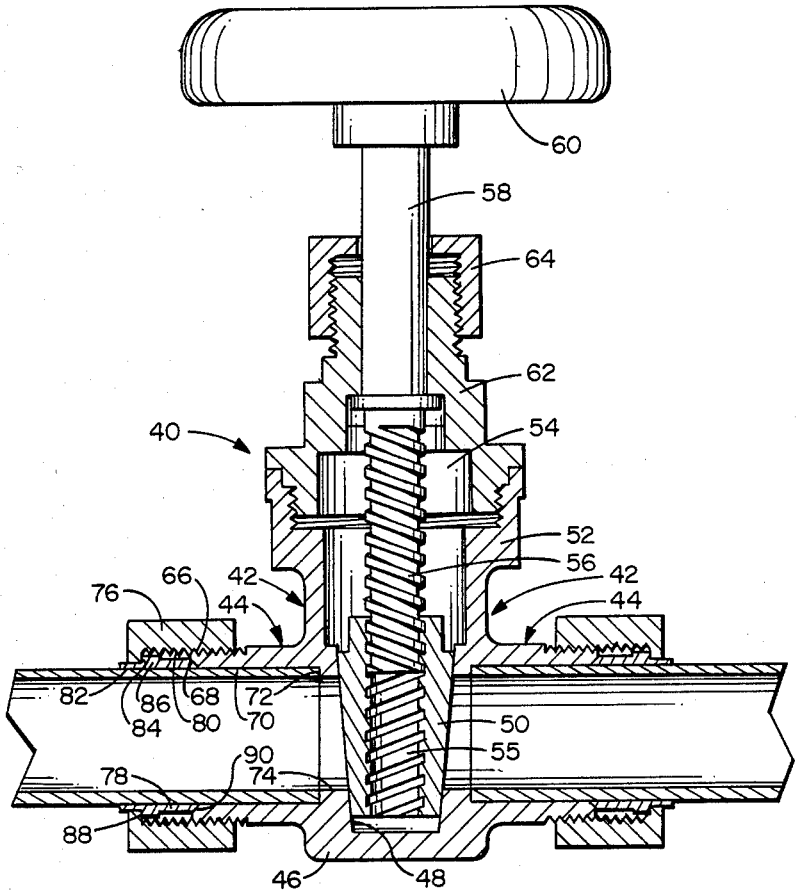
FIG. 5 is a sectional view taken through the vertical center axis of the isolation valve, with the valve being enlarged relative to the showings of FIGS. 2–4.

Reference is made to FIG. 5, which shows the isolation valve 40 of the present invention in more detail. This valve 40 can be considered as having a central operating portion 42, and two connecting portions 44 positioned on opposite sides of the central operating portion 42.

The central operating portion 42 is, in its present configuration, of a conventional configuration, and comprises a housing 46 defining a generally circular recess 48 to receive a generally disc-shaped closure member 50. The recess 48 and closure member 50 may be tapered outwardly to a moderate extent in an upward direction to insure a snug fit of the closure member 50 in the recess 48.

Figure 3:
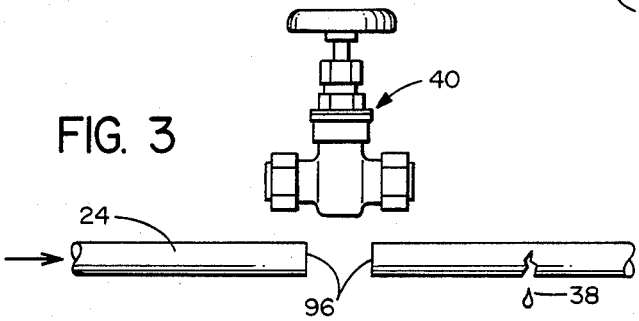
FIG. 3 is a view similar to FIG. 2, showing the cut having been made.

The housing 46 has an upward annular extension 52 which has an open interior 54 to receive the closure member 50 when it is in its upper open position, as shown in FIG. 3. The closure member 50 is interiorally threaded at 55 to receive the lower threaded end 56 of a stem 58 which extends upwardly to join to an operating handle 60. To close the annular extension 52 and receive the stem 58, there is an upper housing member 62 which threadedly engages the main housing member 46 and having a circular through opening to snuggly receive the stem 58. A closure cap 64 is threaded onto the top end of the upper housing member 62, and this also has an opening to receive the stem 58.

The components of the central operating portion 42 of the valve 40 are, as shown herein, of more or less conventional configuration. By rotating the handle 60, the closure member 50 can be moved downwardly to completely occupy the recess 48 and thus totally stop flow through the valve 40. By rotating the operating handle in the opposite direction, the closure member 50 can be moved totally out of the recess 48.

The two valve connecting portions 44 are or may be substantially identical, with the center axes of these aligned with one another. For ease of description, the end of the connecting portion 44 which is further away from the central valve portion 42 will be considered as being at a forward location, while that portion of the connecting portion 44 which is closer to the valve operating portion 42 will be considered as being at a rearward location. The term "outside" will denote a distance further from the center axis of the connecting portion 44, while the term "inside" will denote a location closer to the center axis.

The forward outer surface 66 of each connecting portion 44 is threaded and the extreme forward end has a rearwardly and inwardly tapering surface 68 of a general frusto-conical configuration. The inner surface 70 which is located immediately rearwardly of the tapering surface 68 is cylindrical and has a diameter just slightly larger than the outside diameter of the water-pipe 24 which is to be repaired. At the rear end of the surface 70 there is an annular shoulder 72, having a width dimension approximately the same as the thickness of the pipe 24. Extending further rearwardly from the stop shoulder 72 is an inside surface 74 which is stepped inwardly from the surface 70. This cylindrical surface 74 has a diameter the same as the inside diameter as the pipe 24.

To secure a pipe section to a connecting portion 44 of the valve 40, there is provided for each connecting portion 44 a compression nut 76 and a compression ferrule 78. The nut 76 and the ferrule 78 are, as shown herein, of conventional configuration.

The nut 76 has interior threads 80 which engage the threaded outer surface 66 of the connecting portion 44. At its forward end, the nut 76 is formed with a cylindrical through opening 82 just slightly larger than the outside diameter of the pipe 24, and rearwardly of this opening, the nut 76 has an annular shoulder 84 which faces rearwardly.

The ferrule 78 has a generally annular configuration, and it is provided with an inwardly facing cylindrical surface 86 which fits snuggly against the outside surface of the pipe 24. In addition, the ferrule 78 has a forward and a rear surface 88 and 90, respectively. The rear surface slopes inwardly in a rearward direction to engage the surface 68. The forward surface 88 is positioned to engage the shoulder 84 of the nut 76.

Figure 2:
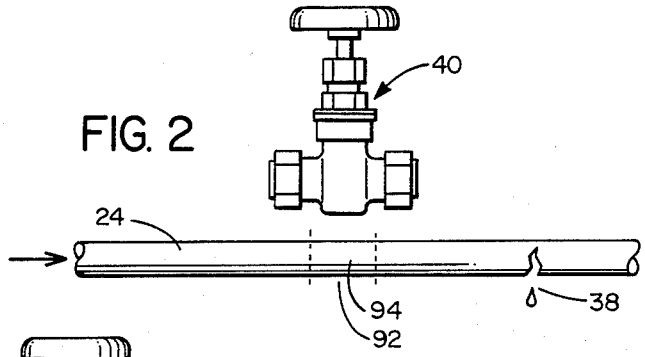
FIG. 2 is a view showing a portion of a distribution pipe having a leak, and indicating a cutting location for an isolation valve of the present invention.

To describe now the method of the present invention, let it be assumed that it is desired to repair the leak 38 shown in FIG. 1. First, a convenient shutoff location 92 is selected a short distance upstream of the leak 38, as shown in FIG. 2, this shutoff location is indicated at 92. Then, the existing shutoff valve 22 upstream of the leak location 38 is closed.

Next, the person returns to the selected shutoff location 92 and cuts out a length of pipe 94 corresponding generally to the distance between the two stop shoulders 72 of the valve 40. With the missing pipe section 94 removed, this leaves two pipe end surfaces 96 facing one another. Then, the valve 40, along with the two compression nuts 76 and the two ferrules 78, is placed in a connecting position between the two sections of the pipe 24. If the two nuts 76 are already threaded onto the two related connecting portions 44, with the ferrule 78 in place, then the two sections of the pipe 24 are manipulated to place each end of the pipe sections into opposite end portions of the valve assembly (i.e. the valve 40, with the compression nuts 76 and ferrule 78). The copper tubing generally used in most water systems is sufficiently flexible so that it is possible to deflect one pipe section 24 out of alignment with the other, place one end of the valve 40 over that pipe end, and then bend the opposite portion of the pipe 42 in a manner to permit the other end portion of the pipe 24 to be inserted in the valve 40.

If the nuts 76 are not threaded onto the valve connecting portions 44, then each nut 76 along with a related ferrule 78 is placed on a related end section of the pipe 24 at the shutoff location 92. Then the valve 40 by itself is placed in the connecting position to the two portions of the pipe 24. With the valve 40, the nuts 76 and the ferrule 78 in place, as shown in FIG. 5, the two compression nuts 76 can be threaded rearwardly (i.e. toward the valve 44) so that the two compression surfaces 68 and 84 press against, respectively, forward and rear surfaces 88 and 90 of the ferrule 78 so as to press the ferrule 78 inwardly into tight engagement with its related portion of the pipe 24.

With the valve 40 inserted in its operating position, the valve handle 60 is turned to move the closure member 50 downwardly into its closed position. This isolates the leak 38 from that portion of the water system upstream of the shutoff location 92 of the valve 40. Then, it is possible to open the main shutoff valve 22 so that water could be delivered to other parts of the system, such as the outlet valve 26.

Figure 4:
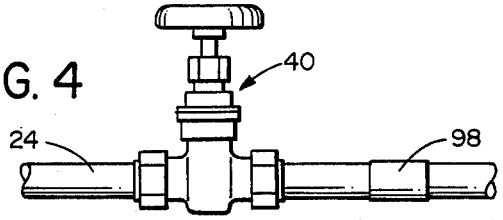
FIG. 4 is a view similar to FIGS. 2 and 3, showing the isolating valve in place and the repair having been made.

With this accomplished, the leak 38 can be repaired in accordance with methods already known in the prior art. For example, a repair collar may be placed around the pipe 24 at the location of the leak 38, or a new section of pipe may be inserted at the location of the leak 38. The structure which accomplishes the leak repair is indicated as a sleeve 98, shown in FIG. 4.

After the leak 38 is repaired, the person making the repair can then immediately open the isolating valve 40 to see if the repair of the leak 38 has been made properly. If it has been made properly (i.e. if no water leaks from the repair sleeve 98), the valve 40 is moved to its full open position and is left in that position indefinitely. On the other hand, if the repair was not properly made, the valve 40 is moved back to its closed position, and further repair work is done on the leak 38. As indicated above, this further repair work can be done in an especially convenient manner for two reasons. First, the person making the repair can remain at the location of the leak 38, since the isolating valve 40 can be placed closely adjacent to the leak 38. Second, other parts of the water distribution system (such as the outlet valve 26) remain operational while the repair is being made.

It should be noted that when the valve 40 is in place and in its fully open position, the inner cylindrical surfaces 74 of the two connecting portions 44 and the central chamber or recess 48 of the main valve housing 76 define a through opening having a cross sectional area the same as that of the pipe 24. Thus, the isolating valve 40, which has now become a permanent part of the water system, does not cause an unwanted pressure drop for water which is flowing through the pipe 24.

Also, it should be noted that if the repair of the leak 38 is not made in the first attempt, so that it is necessary to again close the valve 40 so as to isolate the leak location, the subsequent draining of the pipe 24 at the location of the leak 38 can be accomplished more simply, since a smaller part of the water system must be drained.

It is obvious that various modifications could be made in the method of the present invention, and also in the precise configuration of the valve 40 and its associated elements 76 and 78, without departing from the teachings of the present invention.

What is claimed is:

1. A method of repairing a leak in a water distribution network of a plumbing system where there is:

(a) a distribution pipe having an upstream end and a downstream outlet end, and also having an outside surface of a predetermined outside diameter and an inside surface defining a passageway having a predetermined passageway diameter and passageway cross-sectional area;

(b) an existing shutoff valve located upstream of the upstream end of the distribution pipe;

said method comprising:

(a) determining a leak location of said leak;

(b) operating said existing shutoff valve to stop flow of water to said leak;

(c) selecting an intermediate isolation location in said distribution pipe downstream of said existing shutoff valve and upstream of said leak;

(d) cutting said distribution pipe at said isolation location to form first and second pipe end portions, both of which are substantially undistorted and provide substantially uninterrupted through passageway portions, without enclosing said isolation location in a watertight containment and with said isolation location being open to the surrounding environment;

(e) providing an isolation valve assembly comprising:

1. an isolation valve comprising:

(i) a main body portion defining a central through passageway section having a cross-sectional area at least as great as that of the pipe passageway;

(ii) a valve closure member having a first position closing said central through passageway section and a second position where said central through passageway section is substantially unobstructed;

(iii) a first connecting portion having an interior surface configured to engage an exterior surface of said first pipe portion in connecting relationship, and an exterior threaded surface portion;

(iv) a second connecting portion having an interior surface configured to engage an exterior surface of said second pipe portion in connecting relationship, and an exterior threaded surface portion;

(2) first and second compression nuts, each having an annular integral structure, with an inner threaded surface to engage the threaded surface portion of a related one of said connecting portions, and having a through opening to receive a related one of said pipe portions;

(3) first and second annular compression seal members, each adapted to be positioned around a related pipe portion in sealing engagement between a related one of said compression nuts and a related one of said connecting portions;

(f) inserting said isolation valve at said selected isolating location, with said first and second compression nuts and said first and second seal members being placed over said first and second pipe portions, respectively, and with said first and second connecting portions being around and in connecting engagement with said first and second pipe portions, respectively, and threading said nuts onto their respective connecting portions to bring said seal members in sealing relationship with the first and second pipe portions;

(g) closing said isolation valve;

(h) opening said existing shutoff valve;

(i) repairing said leak;

(j) opening said isolation valve to permit flow of water to said leak location.

2. The method as recited in claim 1, further comprising examining said leak location subsequent to repair to determine if any leak still exists, and if any leak does so exist, then closing said isolating valve and making a further repair to said pipe to remedy said further leak.

3. The method as recited in claim 1, wherein said water distribution system has an operating outlet leading from said distribution pipe at a location upstream of said leak, said method further being characterized in that, upon opening said existing shutoff valve, said upstream operating outlet becomes operational during a period when said leak is being repaired.

4. A valve installation made according to the method of claim 1, wherein with said valve closure member in its second position, there is a substantially unrestricted flow passageway from said first pipe portion through said central through passageway of the isolation valve, to said second pipe portion.

5. The valve assembly as recited in claim 4, wherein each connecting portion of the valve has an annular shoulder to engage an edge portion of its related pipe portion and thus locate said valve relative to the pipe.

6. The valve assembly as recited in claim 5, wherein said closure member is a gate member, with said valve being arranged so that said gate member is moved totally out of alignment with said pipe portion in its open position.

7. The valve assembly as recited in claim 4, wherein said closure member is a gate member, with said valve being arranged so that said gate member is moved totally out of alignment with said pipe portion in its open position.

8. An isolation valve particularly adapted to repair a leak in a water distribution network of a plumbing system where there is a distribution pipe having an upstream end and a downstream outlet end, and also having an outside surface of a predetermined outside diameter, and an inside surface defining a passageway having a predetermined passageway diameter and a passageway cross-sectional area, and an existing shutoff valve located upstream of the upstream end of the distribution pipe, wherein said leak is repaired by providing: means for operating said existing shutoff valve to first close said existing shutoff valve to stop flow of water to said leak, and then opening said existing shutoff valve after installation of said isolation valve and after closing of said isolation valve; means for cutting said distribution pipe at said isolation location to form first and second pipe end portions, both of which are substantially undistorted and provide substantially uninterrupted through passageway portions, without enclosing said isolation location in a watertight containment, and with said isolation location being open to the surrounding environment; first and second compression nuts, each having an annular integral structure, with an inner threaded surface, and having a through opening to receive a related one of said pipe end portions; first and second annular compression seal members, each adapted to be positioned around a related pipe portion in sealing engagement with a related one of said compression nuts; means for inserting said isolation valve at said selected isolating location, with said first and second compression nuts and said first and second seal members being placed over said first and second pipe portions, respectively, and for threading said nuts onto said isolation valve; means for closing said isolation valve in order to repair said leak, and then opening said isolation valve after repair of said leak to permit flow of water to said leak location, said valve comprising:

a. a main body portion defining a central through passageway section having a cross-sectional area at least as great as that of the pipe passageway;

b. a valve closure member having a first position closing said central through passageway section and a second position where said central through passageway section is substantially unobstructed;

c. first and second connecting portions that are connected to said main body portion, each connecting portion configured to engage an exterior surface of a related pipe portion in connection relationship, and an exterior threaded surface portion adapted to engage an inner threaded surface of a related compression nut, and thus compress a related annular compression seal member in sealing relationship around a related pipe portion;

whereby said valve can be inserted at a pipe location to form a substantially unobstructed through passageway between two pipe portions.

9. The valve as recited in claim 8, wherein each connecting portion of the valve has an annular shoulder to engage an edge portion of its related pipe portion and thus locate said valve relative to the pipe.

10. The valve as recited in claim 9, wherein said closure member is a gate member, with said valve being arranged so that said gate member is moved totally out of alignment with said pipe portion in its open position.

11. The valve as recited in claim 8, wherein said closure member is a gate member, with said valve being arranged so that said gate member is moved totally out of alignment with said pipe portion in its open position.

12. An isolation valve assembly particularly adapted to be used in repair of a leak in a water distribution network of a plumbing system where there is a distribution pipe having an upstream end and a downstream outlet end, and also having an outside surface of a predetermined outside diameter, and an inside surface defining a passageway having a predetermined passageway diameter and a passageway cross-sectional area, and an existing shutoff valve located upstream of the upstream end of the distribution pipe, wherein said leak is repaired by providing: means for operating said existing shutoff valve to first close said existing shutoff valve to stop flow of water to said leak, and then opening said existing shutoff valve after installation of said isolation valve and after closing of said isolation valve; means for cutting said distribution pipe at said isolation location to form first and second pipe end portions, both of which are substantially undistorted and provide substantially uninterrupted through passageway portions, without enclosing said isolation location in a watertight containment, and with said isolation location being open to the surrounding environment; means for inserting said isolation valve assembly at said selected isolating location and connecting said isolation valve assembly to said pipe end portions; means for closing said isolation valve in order to repair said leak, and then opening said isolation valve after repair to said leak to permit flow of water to said leak location, said valve assembly comprising:

a. an isolation valve comprising:

1. a main body portion defining a central through passageway section having a cross-sectional area at least as great as that of the pipe passageway;

2. a valve closure member having a first position closing said central through passageway section and a second position where said central through passageway section is substantially unobstructed;

3. a first connecting portion having an interior surface configured to engage an exterior surface of a first pipe portion in connecting relationship, and an exterior threaded surface portion;

4. a second connecting portion having an interior surface configured to engage an exterior surface of a second pipe portion in connecting relationship, and an exterior threaded surface portion;

(b) first and second compression nuts, each having an annular integral structure, with an inner threaded surface to engage the threaded surface portion of a related one of said connecting portions, and having a through opening to receive a related one of said pipe portions;

(c) first and second annular compression seal members, each adapted to be positioned around a related pipe portion in sealing engagement between a related one of said compression nuts and a related one of said connecting portions.

13. The valve assembly as recited in claim 12, wherein each connecting portion of the valve has an annular shoulder to engage an edge portion of its related pipe portion and thus locate said valve relative to the pipe.

14. The valve assembly as recited in claim 13, wherein said closure member is a gate member, with said valve being arranged so that said gate member is moved totally out of alignment with said pipe portion in its open position.

15. The valve assembly as recited in claim 12, wherein said closure member is a gate member, with said valve being arranged so that said gate member is moved totally out of alignment with said pipe portion in its open position.

* * * * *